US005131707A

United States Patent [19]

Zazzara et al.

[11] Patent Number: 5,131,707

[45] Date of Patent: Jul. 21, 1992

[54] HANGER CARRIER

[75] Inventors: Robert G. Zazzara; Carmen Mustico, Jr., both of Elmira Heights, N.Y.

[73] Assignee: Z & M Novelties, Elmira Heights, N.Y.

[21] Appl. No.: 735,080

[22] Filed: Jul. 24, 1991

[51] Int. Cl.[5] ..... B65D 63/18

[52] U.S. Cl. ..... 294/156; 294/153

[58] Field of Search ..... 294/156, 152, 153, 149, 294/165

[56] References Cited

U.S. PATENT DOCUMENTS

| | | | |
|---|---|---|---|
| 2,778,555 | 1/1957 | Poryle | 294/153 X |
| 3,188,130 | 6/1965 | Pietrowicz | 294/170 |
| 3,545,659 | 12/1970 | Libby | 294/149 X |
| 3,584,772 | 6/1971 | Robertson | 294/156 X |
| 3,752,525 | 8/1973 | Hanna et al. | 294/153 X |
| 3,768,711 | 10/1973 | Wilkinson | 294/149 |
| 3,937,394 | 2/1976 | Netschert | 294/165 X |
| 4,043,493 | 8/1977 | Camelio | 294/165 |
| 4,153,189 | 5/1979 | Hughes | 294/156 X |
| 4,537,436 | 8/1985 | Pfortmiller | 294/165 X |

FOREIGN PATENT DOCUMENTS

| | | | |
|---|---|---|---|
| 151386 | 11/1937 | Australia | 294/149 |
| 500407 | 1/1951 | Belgium | 294/153 |
| 510378 | 10/1953 | Belgium | 294/149 |
| 468023 | 9/1950 | Canada | 294/153 |
| 283178 | 4/1915 | Fed. Rep. of Germany | 294/149 |
| 855007 | 4/1940 | France | 294/149 |
| 216845 | 1/1942 | Switzerland | 294/153 |
| 383257 | 12/1964 | Switzerland | 294/149 |

*Primary Examiner*—Margaret A. Focarino
*Assistant Examiner*—Joseph D. Pape
*Attorney, Agent, or Firm*—Fisher, Christen & Sabol

[57] ABSTRACT

A carrier for transporting items such as clothes hangers is provided. The hanger carrier includes a hollow handle made from rigid material. The handle is of appropriate size and shape to be grasped by a user. A cord is provided for wrapping around, and thereby facilitating the carrying of hangers. The cord is threaded through the handle and the two ends of the cord are joined together to form a loop of fixed length. The carrier also includes a pair of hollow end caps which are threaded onto the cord before the ends of the cord are joined together. The end caps are resiliently affixed inside of the ends of the handle to protect the cord.

20 Claims, 2 Drawing Sheets

HANGER CARRIER

BACKGROUND OF THE INVENTION

1. Field of the Invention

The present invention relates, in general, to a device for carrying articles. More particularly, the invention provides a hanger carrier which is useful in transporting a plurality of hangers without injury to the user's hand.

2. Description of Related Art

The problem of transporting large numbers of hangers has plagued modern man since the advent of dry cleaners. People, especially city dwellers, must often carry ten, twenty, or more garments, each on its own hanger, for up to several blocks. In addition to constituting a heavy load, the narrow edges of these weighted hangers can dig into the user's fingers, impairing circulation and causing stiffness and unsightly marks. These problems are further exacerbated for the aged, handicapped or persons suffering from arthritis.

Additionally, when large numbers of garments, and hence, hangers are carried (e.g., by professional dry cleaners), the person's hand must hold each individual hanger or it will slip out of the bunch and fall to the ground. When this happens, since bunches of hangers are often carried over the shoulder, the most favorable outcome will be that the garment is soiled. If the person does not feel the garment falling, however, the garment may be lost.

Other problems also exist which limit the usefulness of ungrouped hangers. For example, to pass a group of hangers from one person to another, e.g., as a dry cleaning delivery person does when making a delivery, the second person must insert his/her fingers within the looped end of each hanger, while the first person is still holding the hangers. Often it is impossible for both people to find room for their fingers and the transfer of hangers is awkward and often results in one or both persons being poked by the sharp ends of the hangers' hooks.

Other problems, some of which analogous to those discussed above in the context of carrying hangers, have long made carrying other burdens difficult. A wide variety of devices have been developed which attempt to solve these problems.

For example, Canadian Patent No. 468,025 discloses a carrier for cartons or the like comprising a rigid tubular handle made of wood, paperboard, metal, plastic or the like, and a strand of rope. Each end of the rope is passed through the handle and knotted individually (as shown at 3). The carrier is looped around packages as shown in FIG. 2.

U.S. Pat. No. 3,188,130 to Pietrowicz ("Pietrowicz") discloses a small game hanging device. Pietrowicz discloses a hollow tubular member (1) having removable end caps (15, 16) fitted over the ends of the tube and a looped thong (11) for attaching the animal and hanging the device. In Pietrowicz, the length of the thong (11) may be adjusted by knotting the ends of the thong (11). The ends of the thong (11) are not knotted together, but rather are individually knotted; the ends being locked in place within the handle behind the end caps (15, 16).

Swiss Patent No. 216,845 discloses a hollow tube handle with a stopper (2) which may be removed to provide access to a net bag (5). The net (5) is anchored to the handle by a knot (6) passed through the handle.

Swiss Patent No. 383,257 discloses a carrier for firewood having a cord (13) and a hollow handle (9). The ends of the cord are not knotted together and means for adjusting the length of the cord do not appear to be disclosed. Furthermore, the cord is held within the handle by inserting it into a slot (10).

Belgian Patent No. 500,407 discloses a carrier for sacks and suitcases. The carrier has a hollow handle (1) and string (2) having knotted ends (3). The string is attached to a special notched plate affixed to a bag.

While these devices all have positive attributes, they all have inherent problems. Furthermore, none of the known prior art devices is specifically designed to facilitate carrying large numbers of hangers without injuring the carrier's fingers, wrist and/or shoulder.

SUMMARY OF THE INVENTION

The present invention seeks to solve the problems and avoid the suboptimizations inherent in the previously-developed devices by providing a carrier for transporting items such as clothes hangers. The inventive hanger carrier includes a hollow handle made from rigid or resilient material. The handle is of appropriate size and shape to be grasped by a user. A cord is provided for wrapping around, and thereby facilitating the carrying of hangers. The cord is threaded through the handle and the two ends of the cord are joined together, preferably permanently, to form a loop of fixed length. The carrier also includes a pair of hollow end caps which are threaded onto the cord before the ends of the cord are joined together. The end caps are resiliently affixed inside of the ends of the handle to protect the cord from abrading against the edges of the handle.

In this way, a simple, inexpensive device is provided which is capable of transporting a variety of objects without injuring the user's hand.

BRIEF DESCRIPTION OF THE DRAWINGS

The novel features believed characteristic of the invention are set forth in the appended claims. The invention itself; however, as well as the preferred modes of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

The preferred embodiment of the hanger carrier of the present invention may be better understood by reference to the drawings, wherein like numerals refer to like elements throughout.

Figure 1:
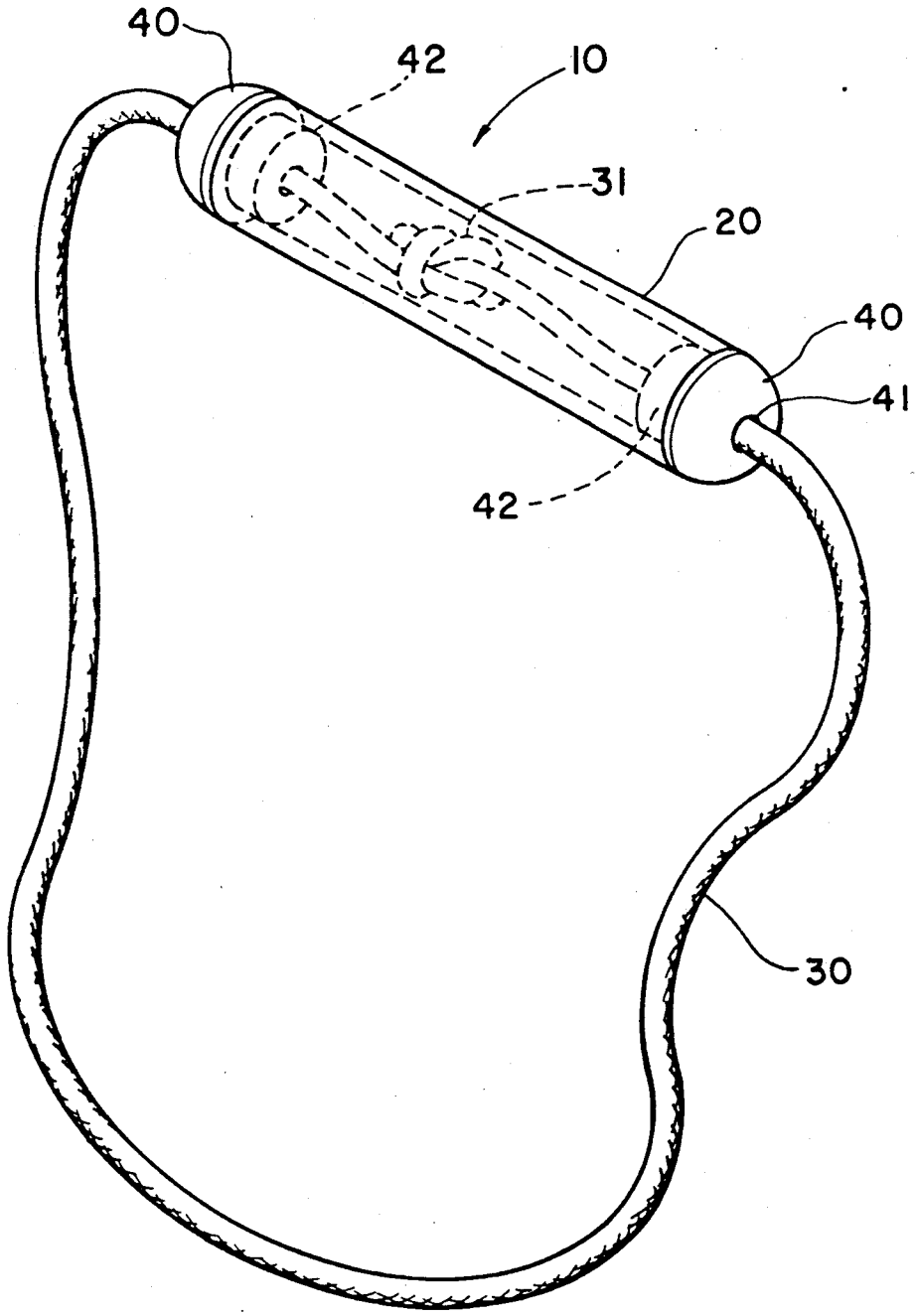
FIG. 1 is a perspective view of the inventive hanger carrier showing, in phantom lines, the cord and the flanges of the end caps within the handle of the carrier.

In FIG. 1, the three primary components of the inventive hanger carrier 10 can be seen. The hanger carrier comprises a handle 20, a cord 30 and a pair of end caps 40.

As seen in FIG. 1, the handle 20 is hollow in order that the cord 30 may pass therethrough. The handle 20 may be made from a wide variety of materials, e.g., wood, plastics, metal, cardboard, etc. Preferably, fairly rigid materials are used to fabricate the handle 20, for example, wood or plastics. This rigidity helps to avoid concentrating the weight of the load being carried with the device onto only one segment of the user's hand and facilitates passing the carrier from one person to another. Alternatively, however, less rigid materials such as rubber tubing may also be used to form the handle 20 in some circumstances. Most preferably, because of their low cost, a suitable plastic material such as polyvinyl chloride (PVC) is used to form the handle 20 of the hanger carrier 10.

An added benefit ancillary to making the handle 20 from plastics such as PVC is that the color of the plastic may be easily altered to taste and indicia means, e.g., stickers or embossed or incised letters, may be easily added to the handle 20 to identify a particular group or organization. In this way, the inventive hanger carrier 10 can be a very useful tool in fund-raising efforts, i.e., since they are inexpensive to produce and can easily be customized to highlight the name of a particular school or civic organization.

The handle 20 is preferably about five inches in length and about one inch in diameter (outside). Obviously, a wide variety of sizes may be used, but handles 20 in this approximate size range appear to be easy to grasp, provide good spreading of the load being carried and are still small enough to be easily stored when not in use. As shown in FIG. 1, the handle 20 is preferably cylindrical in shape to facilitate easy carrying. but in some circumstances, handles of other general configurations may be utilized, e.g., ovoid, triangular, square, etc. (i.e., in cross-section).

Figure 3:
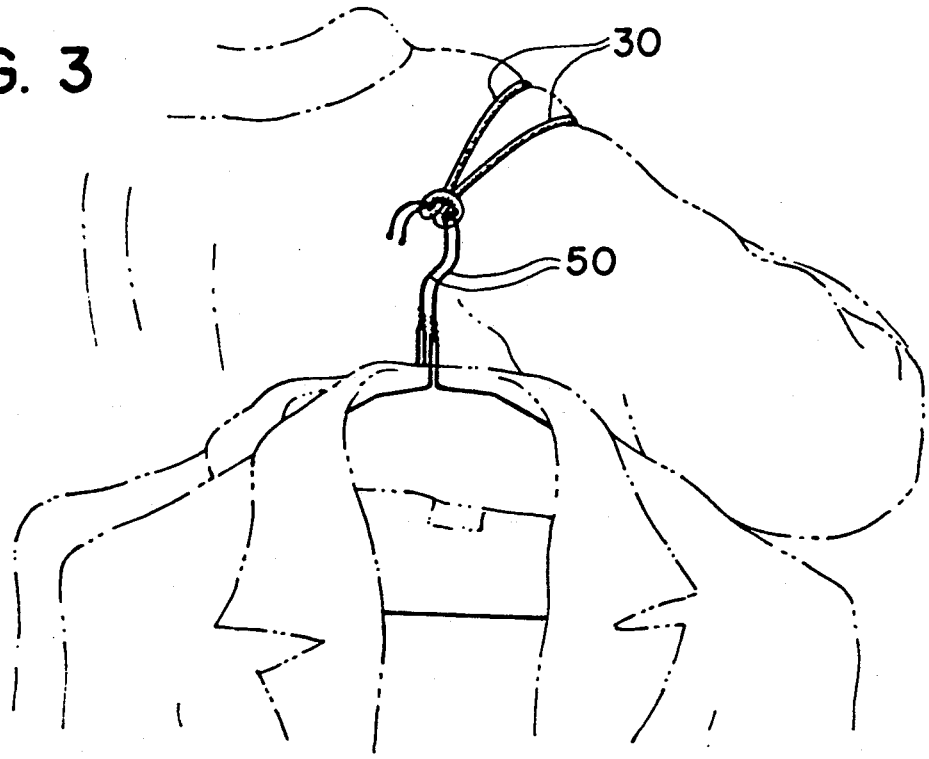
FIG. 3 is a perspective view of the inventive hanger carrier being used to carry several garments and being slung over the user's shoulder.

The cord 30 may be fabricated from a wide variety of materials, e.g., jute, nylon, hemp, DACRON® (or other suitable synthetic fiber), metal or various plastics. The cord 30 may be coated with plastic to increase the life thereof. Since coatings can diminish the flexibility (and ability to wrap around hangers) of the cord 30, however, the cord 30 is most preferably not coated. Since in use (as shown in FIG. 3) the cord is often slung across the user's shoulder, the cord 30 is preferably fairly soft (e.g., nylon or DACRON®).

The cord 30 may be configured to have an adjustable length (e.g., by knotting together the two ends of the cord at different places and storing the excess cord 30 inside the hollow handle 20). More preferably, however, the cord 30 has a fixed length. A cord 30 having a fixed length can provide increased weight-bearing capability and reliability (e.g., instead of two individually-knotted ends—as in Canadian Patent No. 468,025, U.S. Pat. No. 3,188,130, Swiss Patent No. 383,257 and Belgian Published Patent Document No. 500,407—either of which can come undone, thereby destroying the utility of the device). The ends of the cord 30 may be joined together (e.g., at juncture 31 in FIG. 1) to form a continuous loop of cord 30 in any suitable fashion, e.g., by knotting (shown in FIG. 1), melting, chemical bonding, braiding, twisting (i.e., when wire is used as the cord 30), taping or clipping with an appropriate mechanical device or through combinations of these methods. The loop-forming mechanism and/or process preferably increases the diameter of the cord 30 somewhat to prevent the joined ends 31 of the cord 30 from slipping out of the handle 20 (i.e., out through the holes 41 in the end caps 40—whereby the joined ends 31 of the cord 30 could impair manipulation of the cord around hangers 50, see, FIG. 2, and could increase wear on the junction 31 of the cord ends). Most preferably, the least expensive, quickest, easiest and yet most reliable materials and/or methodology will be used to join together the ends of the cord 30 to form a loop.

The length of the cord 30 (i.e., the fixed-length loop of cord utilized with any particular hanger carrier 10) can vary considerably, e.g., from, for example, abut ten to about sixty inches or more. More preferably, however, the length of the looped cord 30 is about twenty to about thirty inches. Most preferably, the loop of cord 30 has a length of about twenty-five inches (with versions of the hanger carrier 10 wherein the length of the cord 30 is variable, the length of the cord 30 will also preferably be within these ranges). Furthermore, as shown in FIG. 3, the cord 30 preferably is of reasonably heavy gauge, e.g., about 3/16 inch thick, in order that it will not overly dig into the user's shoulder.

The third primary component of the inventive hanger is the end caps 40. As shown in FIG. 1, one end cap 40 is used for each end of the handle 20. The end caps 40 preferably each include a hole 41 to allow the cord 30 to slide therethrough. Preferably, the cord 30 is threaded through the end caps 40 before the junction of the cord ends 31 is formed. Alternatively, however, end caps 40 having a slot (rather than a hole 41) could be utilized, thereby allowing the end caps 40 to be slipped onto the cord 30 (and inserted into the handle 20) after the ends of the cord 30 have been joined together.

The end caps 40 are preferably made from wood, metal, cardboard or plastic. More preferably, a suitable plastic material (e.g., PVC) is used to fabricate the end caps 40. The end caps 40 may have a variety of configurations, e.g., cylindrical, square, pyramidal, etc. For example, the end caps 40 may be configured to extend outwardly perpendicular to the length of the handle 20 in a fashion analogous to the raised ends on a spool of thread (this configuration, for example, would allow the hanger carrier to be hung on hooks in a car and the handle 20 thereof used to hold a plurality of hangers in place). The end caps 40 may also be fabricated in a variety of decorative patterns, e.g., in the shape of a school mascot, in order to facilitate the use of the hanger carrier in fund-raising efforts. Preferably, however, as shown in FIG. 1, the end caps 40 have semi-spherical ends to augment the carrying comfort of the hanger carrier 10.

In addition to providing an attractive accent to the hanger carrier 10 and maintaining the juncture of the cord ends 31 within the handle 20 (and, in versions of the hanger carrier 10 wherein the length of the cord 30 is adjustable, maintaining the excess cord 30 within the handle 20) the end caps 40 keep the handle 20 from abrading, and eventually, cutting the cord 30. This protection allows the lengths of handle 20 to be cut more quickly and inexpensively.

The end caps 40 are preferably resiliently affixed to the handle 20 in any suitable fashion, e.g., gluing, welding, heat or ultrasound bonding, etc. With versions of the hanger carrier 10 wherein the length of the cord 30 is adjustable, the end caps 40 are releasably affixed to the handle 20, whereby the end caps 40 may be removed and the length of the cord 30 may be adjusted. With versions of the inventive hanger carrier wherein the length of the cord 30 may not be adjusted, however, the end caps are more preferably permanently affixed to the handle 20. Most preferably, the end caps 40 include a flange 42 to which glue may be applied and which may thereafter be inserted into the handle 20. Inserting the end caps 40 into, rather than over the handle 20 beneficially decreases the chance that the end caps 40 will come loose from the handle 20 and avoids disrupting the aesthetically pleasing smooth visual appearance of the hanger carrier 10 (see, FIG. 1). Affixing the end caps 40 within the handle 20 (rather than overlying the handle 20) also avoids the creation of raised edges which could uncomfortably press against the user's hand when the device is used to carry large loads.

Figure 2:
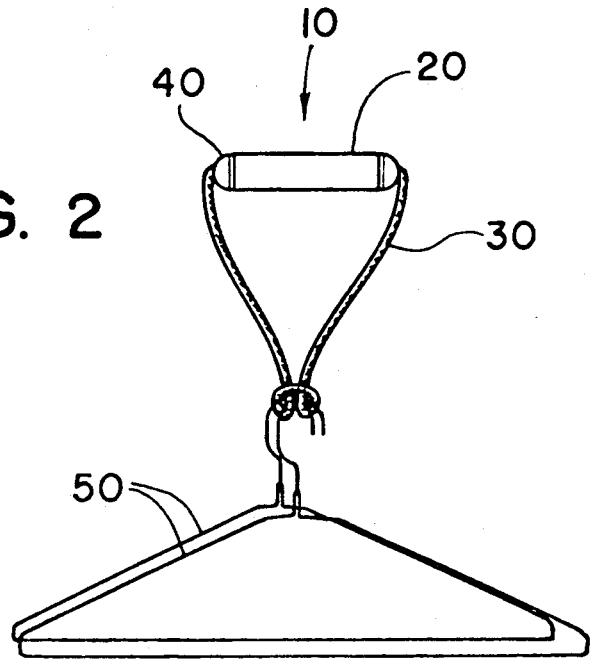
FIG. 2 is a perspective view of the inventive hanger carrier being used to hold together a group of hangers.

As seen in FIGS. 2 and 3, the use of the hanger carrier 10 is quite simple. The cord 30 is simply looped around the tops of the hangers 50 which the user wishes to carry (e.g., in a clove-hitch knot) and the items are carried (e.g., over the user's shoulder—see, FIG. 3). The cord 30 tightens around the hanger 50 tops, thereby preventing any hangers from slipping out of the cord 30 and being lost.

The invention is not limited to what has been specifically shown and described above for purposes of exemplary illustration. For example, although the inventive device is particularly well suited to use in carrying hangers, other objects may also be carried as well. Hence, the scope of the invention is defined only by the claims which follow.

What is claimed is:

1. An apparatus for carrying loads such as clothing hangers comprising:

(a) a hollow handle;

(b) a cord, the ends of said cord being joined together after said cord has been threaded through said handle to form a loop; and (c) a pair of end caps, said end caps being threaded onto said cord, said end caps being affixable to said handle to limit degradation of said cord by said handle; the joined ends of said cord being disposed within said handle, between said pair of end caps.

2. The carrier apparatus of claim 1, wherein said handle is rigid.

3. The carrier apparatus of claim 1, wherein said handle is resiliently flexible.

4. The carrier apparatus of claim 1, wherein said handle is about five inches long.

5. The carrier apparatus of claim 1, wherein said handle is cylindrical.

6. The carrier apparatus of claim 1, wherein said handle is made of plastic.

7. The carrier apparatus of claim 1, wherein said cord is made from a material selected from the group consisting of: nylon, jute, hemp, DACRON ®, and combinations thereof.

8. The carrier apparatus of claim 7, wherein the length of said cord is adjustable.

9. The carrier apparatus of claim 7, wherein the length of said cord is fixed.

10. The carrier apparatus of claim 9, wherein the length of said cord is about twenty to thirty inches.

11. The carrier apparatus of claim 9, wherein the ends of said cord are joined together by knotting, gluing, melting, welding or a similar process.

12. The carrier apparatus of claim 9, wherein the ends of said cord are joined together by mechanical joining means.

13. The carrier apparatus of claim 8, wherein the ends of said cord are joined together by a mechanical joining means or by knotting.

14. The carrier apparatus of claim 1, wherein each of said end caps includes a hole disposed therethrough, whereby said cord may be threaded through said end caps.

15. The carrier apparatus of claim 1, wherein each of said end caps includes a slot disposed therein, whereby said end caps may be threaded onto said cord.

16. The carrier apparatus of claim 1, wherein each of said end caps includes a flange for insertion into said handle, whereby said end caps do not overly said handle.

17. The carrier apparatus of claim 16, wherein said end caps are permanently affixed within said handle.

18. The carrier apparatus of claim 17, wherein the exposed portion of said end caps is semispherical in shape.

19. An apparatus for carrying loads such as clothing hangers comprising:

(a) a hollow handle;

(b) a cord, the ends of said cord being joined together after said cord has been threaded through said handle to form a loop; and (c) a pair of end caps, said end caps being threaded onto said cord, said end caps being affixable to said handle to limit degradation of said cord by said handle; the joined ends of said cord being disposed within said handle, between said pair of end caps; wherein each of said end caps includes a hole disposed therethrough, whereby said cord may be threaded through said end caps, and whereby said cord may slide within said handle.

20. An apparatus for carrying loads such as clothing hangers comprising:

(a) a hollow handle;

(b) a cord, the ends of said cord being joined together after said cord has been threaded through said handle to form a loop; and (c) a pair of end caps, said end caps being threaded onto said cord, said end caps being affixable to said handle to limit degradation of said cord by said handle; the joined ends of said cord being disposed within said handle, between said pair of end caps; wherein said end caps are permanently affixed within said handle.

* * * * *